United States Patent [19]

Lauersdorf et al.

[11] 4,311,460

[45] Jan. 19, 1982

[54] INSULATED INDUSTRIAL OVEN

[75] Inventors: Duane H. Lauersdorf, Watertown; Larry A. Camp, Mukwonago, both of Wis.

[73] Assignee: Wisconsin Oven Corp., East Troy, Wis.

[21] Appl. No.: 207,440

[22] Filed: Nov. 17, 1980

[51] Int. Cl.[3] ..... F27D 1/00

[52] U.S. Cl. ..... 432/247; 110/336; 126/65; 266/285; 432/251

[58] Field of Search ..... 266/285, 286; 432/247, 432/251; 110/332, 336; 126/21 R, 65

[56] References Cited

U.S. PATENT DOCUMENTS 1,078,667 11/1913 Faulds ..... 432/247

3,993,433 11/1976 Isaksson et al. ..... 432/247

4,059,398 11/1977 Zimmer et al. ..... 432/247

*Primary Examiner*—John J. Camby

*Attorney, Agent, or Firm*—James E. Nilles

[57] ABSTRACT

An industrial oven for heating products therein of the type having four insulated side walls, an insulated top, and also a bottom which together define an interior heating chamber. Each of the walls has an inner skin and an outer skin spaced apart from one another, and further has insulation material between those skins. A structural steel framework supports and is located between the skins, and the inner skin is of a generally vertically corrugated sheet metal. Means are provided between the skins for holding the insulation material against the inner skin and spaced from the outer skin to thereby provide an air space between the insulating material and the interior surface of the outer skin.

16 Claims, 9 Drawing Figures

INSULATED INDUSTRIAL OVEN

BACKGROUND OF THE INVENTION

1. Field of Use

This invention relates generally to industrial ovens for heating and/or drying products, such as for example, for drying products after a painting operation. In particular, it relates to an oven constructed to reduce heat losses.

2. Description of the Prior Art

Industrial ovens for indoor and outdoor use are well-known in the art and are typically of a butt joint or a tongue and groove construction. The walls of prior art ovens often have a plurality of vertical panels, with tongue and groove joints between the panels, which abut to form an inner and outer wall.

Expansion and contraction of the oven walls of the prior art construction occurs during the oven's operation, and the joint between the adjacent panels must accommodate this expansion. The construction of one type of prior art panel includes a panel end which is generally of U-shaped configuration when viewed in plan, including a central web that conducts heat outwardly thru the wall at each joint. In other types, the joints do not adequately close and a gap then remains through which heat may readily escape.

Prior art ovens with insulated side walls enclosing an interior heating chamber and having an inner and outer skin include the oven described in U.S. Pat. No. 4,059,398, issued to Zimmer et al on Nov. 22, 1977. The wall has an insulating air space, but the air space communicates with the ambient outside the oven and requires a fan to force cooling ambient air therethrough in an attempt to prevent the outer skin from becoming excessively hot.

An oven having a structural steel framework for supporting the inner and outer skins of walls is shown in U.S. Pat. No. 3,717,939, issued to Mitchell on Feb. 27, 1973. The horizontal structural elements are rigidly connected at their ends to the vertical structural elements. This rigid connection is undesirable because as the horizontal structural elements are heated during operation of the oven, they expand outwardly and towards the vertical elements to place damaging stress on the framework. In addition, some of the vertical structural elements are outside of the walls, permitting conduction heat losses from those elements.

SUMMARY OF THE INVENTION

An industrial oven for heating products therein is provided, having an inner and outer skin of a generally vertically corrugated sheet metal.

The oven is of the type having four insulated side walls, an insulated top, and a bottom which together define an interior heating chamber. The inner and outer skins are spaced apart from one another and have insulation material therebetween and also have a structural steel framework for supporting the skins. Means are provided between the skins for holding insulation material against the inner skin and spaced from the outer skin to provide an air space between the insulation material and the outer skin.

The inner skin is secured to the framework by fastening means passing through the inner skin and secured to the framework. The insulation bears against the inner skin to urge it away from the framework for the majority of its area except where the fastening means are located, reducing conductive heat transfer from the inner skin to the framework.

The structural framework includes a plurality of generally horizontally disposed steel beams and vertical support posts. A slideable connection is provided between the vertical posts and horizontal beams, and comprises a slotted bracket and bolt means.

The means for holding the insulation against the inner skin and apart from the outer skin comprises wires stretched across the insulating material and secured to the framework. The present oven wall may comprise panels with narrow corrugations. The panels overlap each other, and as the oven and its walls are heated, the panels expand and contract in an accordion-like manner. Vertically-adjacent panels of the inner skin overlap, and expansion of the panels is accommodated by their relative slideable vertical movement. The overlapping panels of the present oven walls eliminate panel rails of the prior art ovens which conduct heat through the walls and also eliminate open or openable joints existing in the walls of prior art ovens. The air space between the outer skin and the insulation adjacent the inner skin is sealed to prevent interior heating chamber air or ambient air from communicating with the air space, providing additional thermal insulation. The slideable connection between the vertical posts and horizontal beams permits expansion of the horizontal beams at their ends without stressing the framework. Furthermore, conduction heat losses from the structural framework are reduced by enclosing it entirely within the inner and outer skin. Other objects of the invention will appear in the specification.

DESCRIPTION OF A PREFERRED EMBODIMENT

Figure 1:
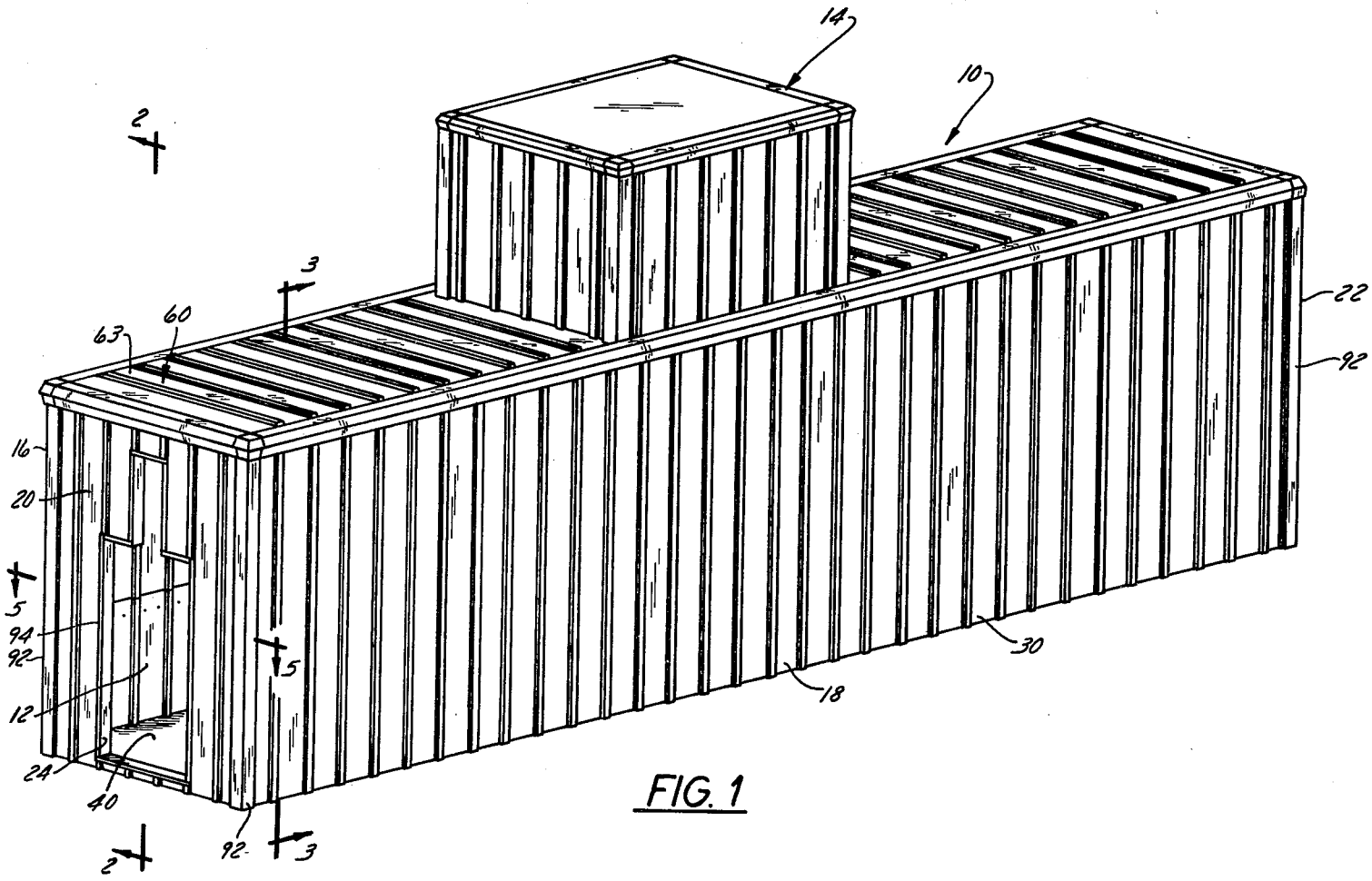
FIG. 1 is a perspective view of an industrial oven in accordance with the present invention.
Figure 2:
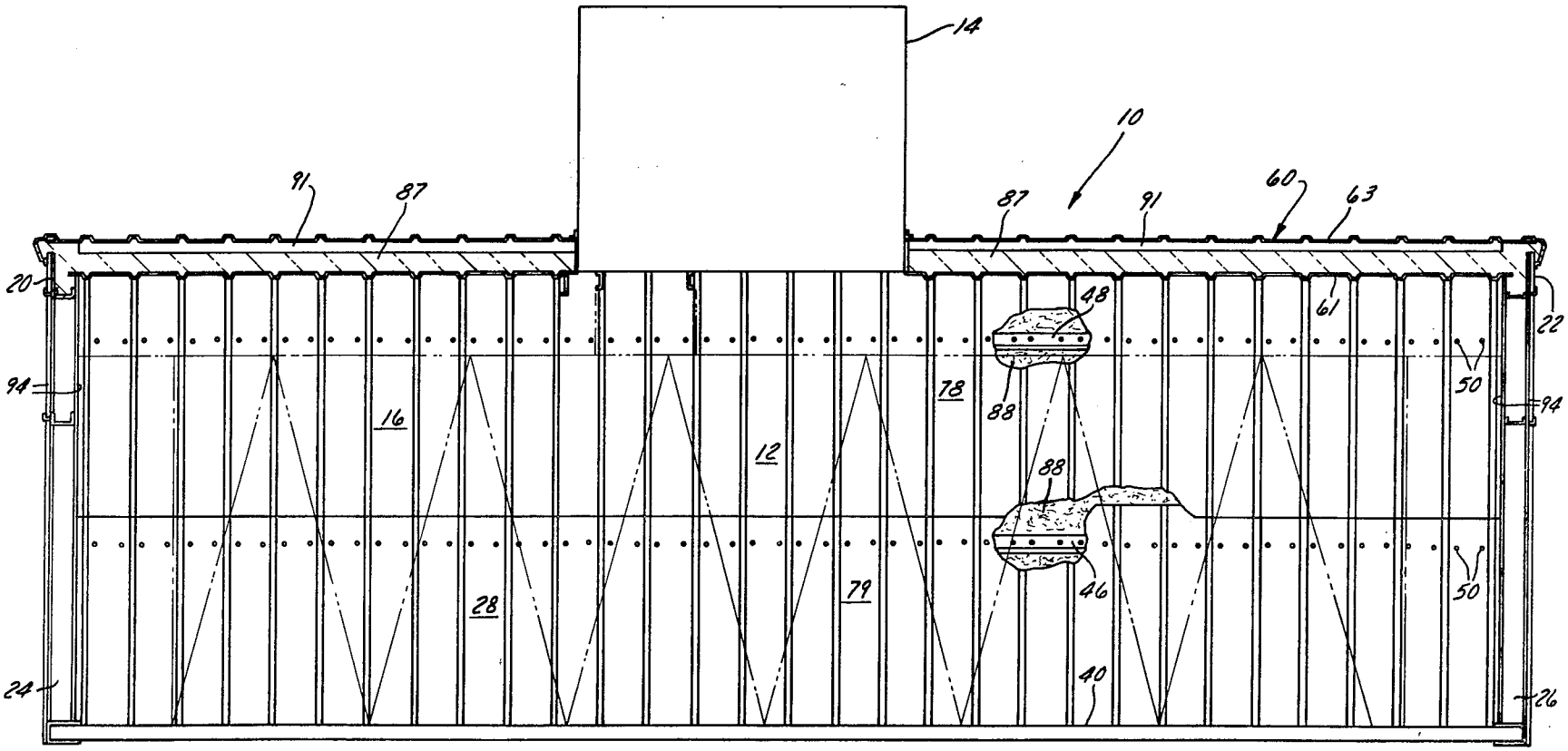
FIG. 2 is a cross sectional view of the industrial oven taken on line 2—2 of FIG. 1 but on an enlarged scale, and further showing certain parts broken away for clarity.

The industrial oven 10 (FIG. 1) is of the type having four insulated side walls, an insulated top and a bottom which together define an interior heating chamber 12, and the oven may include a heater house 14. The four side walls include a pair of side walls 16 and 18 and a pair of end walls 20 and 22. Doorways 24 and 26, may be located in the end walls, or elsewhere as determined by the type of oven utilizing the invention, including bottom-loading or top-loading ovens.

Structural Steel Framework

Figure 9:
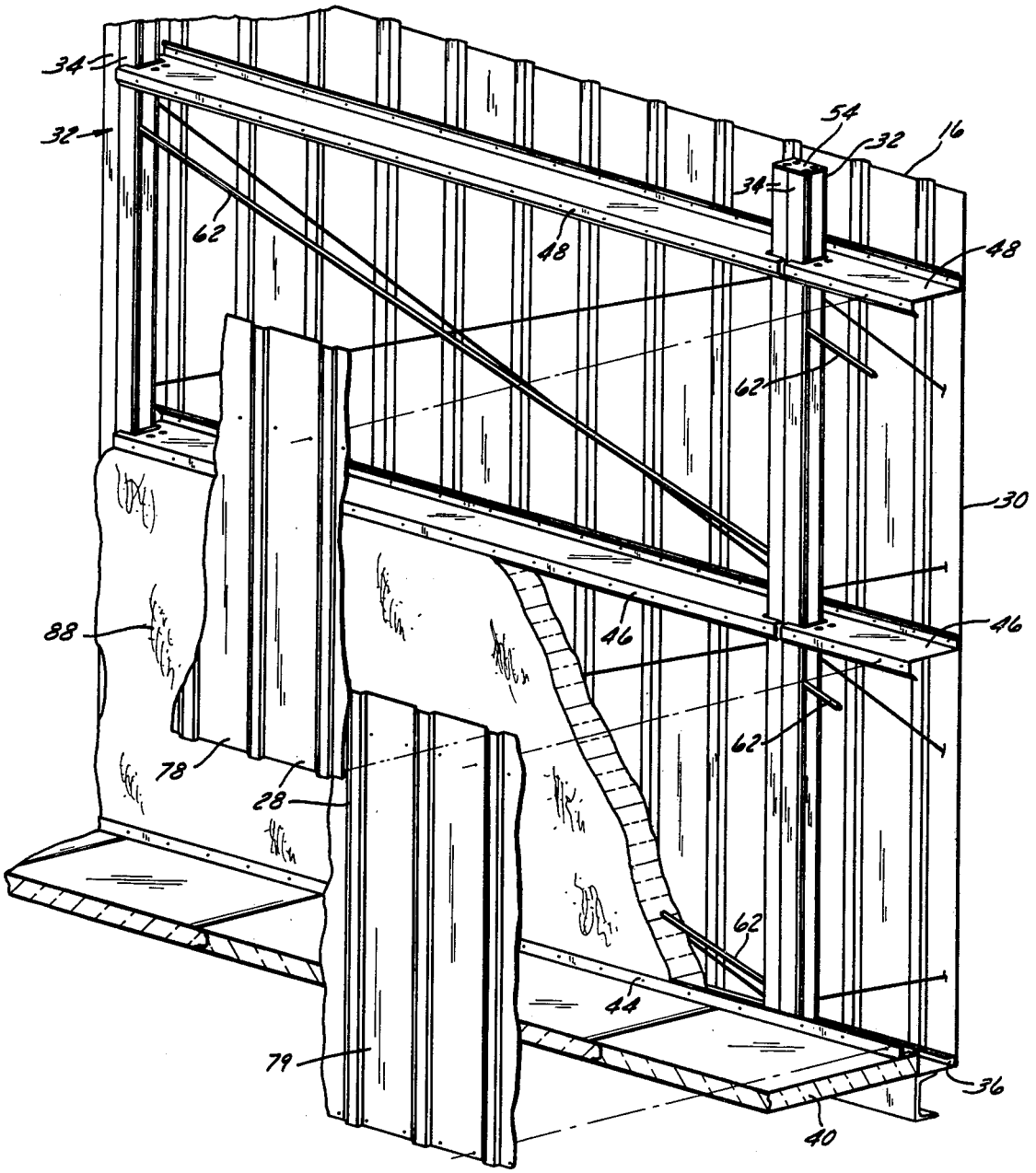
FIG. 9 is a perspective, fragmentary, exploded view of a typical portion of the wall of the industrial oven shown in FIG. 1 but on an enlarged scale and as viewed from the interior heating chamber.

A structural steel framework is provided for supporting inner skin 28 and outer skin 30 of the oven. FIG. 9 shows a section of wall 18, cutaway to reveal the structure between the skins 28 and 30. A plurality of vertical support posts 32 are spaced at equal intervals along the length of the wall, the post being of any suitable cross section, such as a pair of channels 34 welded together along the backs of their webs to form a post similar to an I-beam. Girt channels 36 with upwardly-facing flanges define the bottom of the wall. One of the flanges is apertured to receive screws 38 (FIG. 3) attaching the lower end of outer skin 30 to the channel 36, and the other flange abuts and is attached to bottom 40. Bottom 40 must often be of sufficient strength to support conveyors transporting products through the oven in a continuous heating process. Fixedly attached to the bottom 40 is an apertured angle 44 for receiving screws (not shown) for attaching the lower end of inner skin 28 to angle 44.

Figure 8:
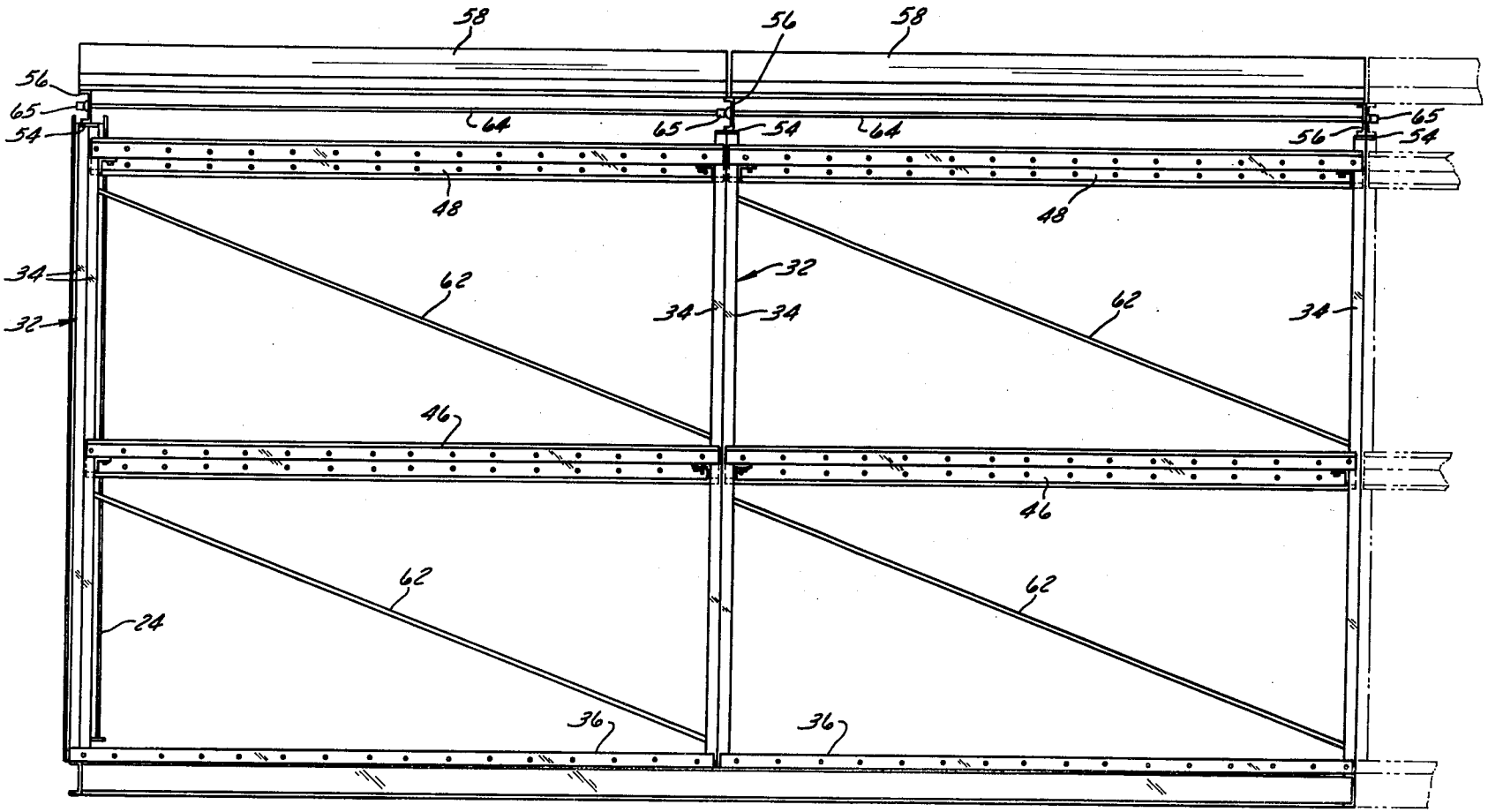
FIG. 8 is a side view of a portion of the structural steel framework of the oven.

Spaced above and parallel to the girt channels 36 are generally horizontally disposed steel beams, here comprising Z-beams or zees 46 and 48, for supporting the skins and attached at their ends to the vertical support posts 32. The opposite flanges of each zee are apertured to receive screws 50 and 52 attaching the inner 28 and outer skins 30, respectively, to the zees. An apertured plate 54 (FIGS. 5 and 9) is welded atop each of the support posts 32. Boltably attached to the plates 54 and traversing the width of the oven are ceiling support channels 56 (FIG. 8). A plurality of horizontal Z-beams 58 similar to zees 46 and 48 are welded to an adjacent pair of transverse channels 56 and are parallel to lengthwise walls 16 and 18. The Z-beams comprise the main structural element of the insulated top 60, which is of similar construction to wall 16, having an inner skin 61 and outer skin 63, insulation, and an air space.

Rigidity is added to the framework by a plurality of diagonally-oriented bracing rods 62 and 64 attached at their threaded ends by hex nuts 65 to adjacent vertical support posts 32 and adjacent ceiling support channels 56, respectively. The rods ensure that parallelism will be maintained between adjacent support columns and between adjacent ceiling support channels. The oven's framework, including vertical support posts and zees, is within the inner and outer skins of the wall or insulated top and does not extend into or communicate with the interior heating chamber, thereby preventing excessive heating of the framework. In addition, the framework does not extend past the outer skin but instead is located entirely between the skins.

Slideable Connection Between Vertical Posts and Horizontal Beams

Figure 6:
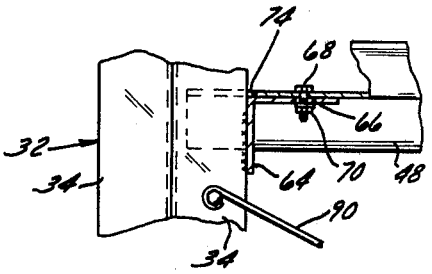
FIG. 6 is a fragmentary, sectional view taken on line 6—6 of FIG. 5 but on an enlarged scale, and showing the slideable connection between the vertical support posts and the horizontal beams.
Figure 7:
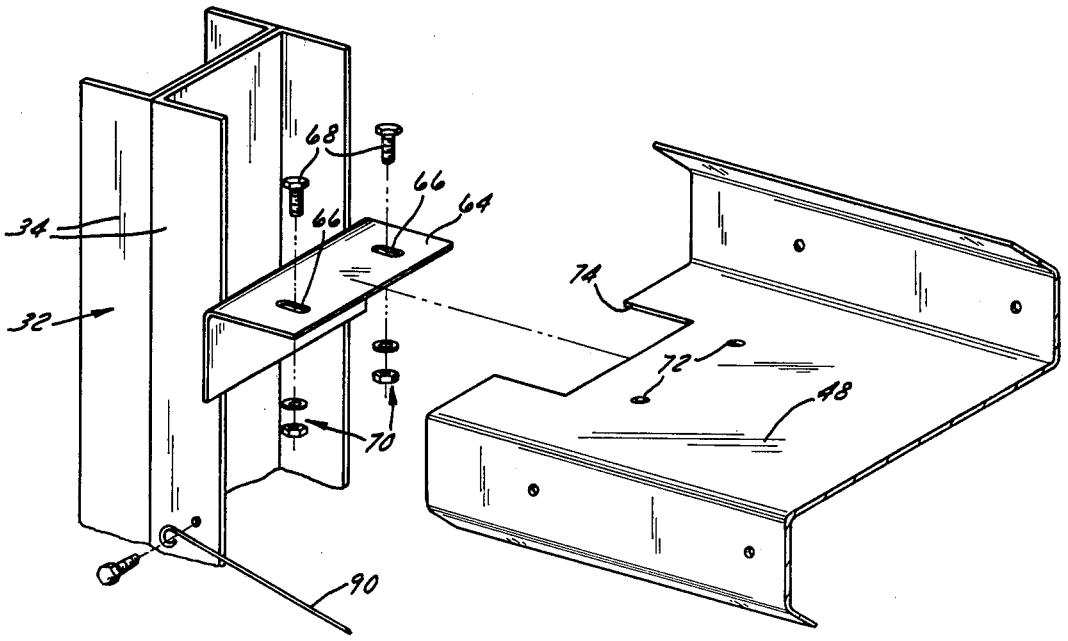
FIG. 7 is an enlarged, perspective, exploded view of the slideable connection means shown in FIGS. 5 and 6.

The horizontal beams or zees 46 and 48 are attached at their ends to vertical posts 32 by means of slideable connection (FIGS. 6 and 7) between the vertical support posts and the zees and comprise a slotted bracket and bolt means, including an angle clip 64 welded to a support post and having oblong slots 66, a pair of bolts 68, and nut and washer means 70. The web of the zee has apertures 72 to be aligned with slots 66 and for receiving bolts 68 and thereby the zees 46 and 48 can expand and contract along their lengths due to this slotted connection.

Expansion slots 74 are also provided in the end of each zee so as to embrace the vertical posts, to thereby ensure that the end of the zee does not abut against the angle clip 64 or the support posts 32 due to expansion of the zee. Each of the bolts is torqued to a precise and consistent value, to ensure that each end of a zee will slide uniformly towards its adjacent support column upon heating of the oven. The slideable connection thus prevents damage or buckling of the framework members.

Inner and Outer Skin of Walls

With the above construction, the side walls 16 and 18 have an inner 28 and an outer skin 30 which are attached to and supported by the structural framework. The interior surface of the inner skin or outer skin is that surface of the respective skin facing the structural framework. The inner skin comprises a plurality of panels 78 and 79 (FIG. 9), panels 78 and 79 being part of a lower and an upper tier of panels, respectively, of generally vertically corrugated sheet metal, the panels being attached to the zees 46 and 48 with screws 50 and overlapping each other to eliminate gaps between adjacent panels. As the interior heating chamber becomes increasingly hot, the panels expand both vertically and horizontally. Vertical expansion is accommodated at the overlap between vertically adjacent panels 78 and 79, the panels vertically sliding over one another.

Figure 3:
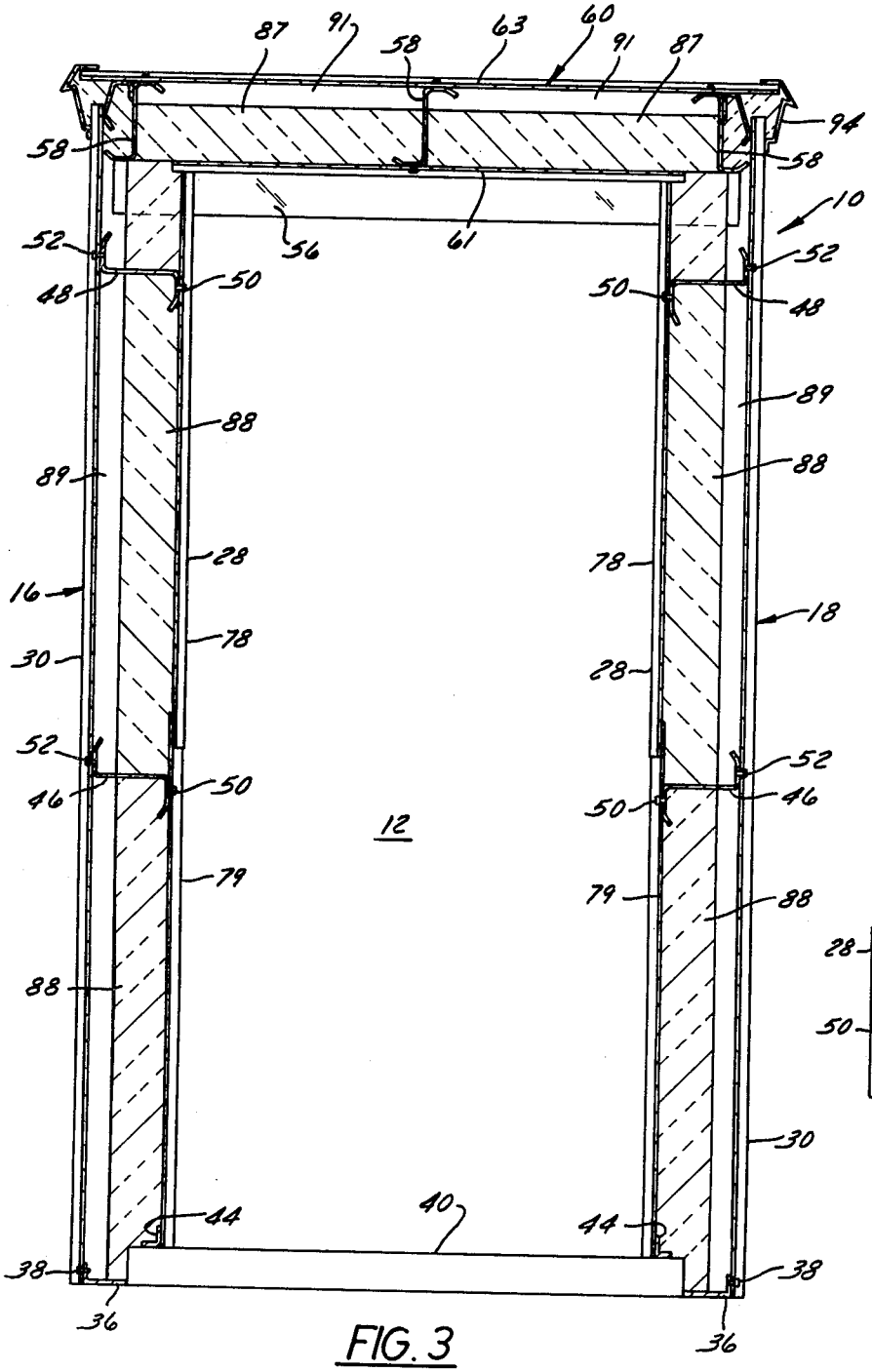
FIG. 3 is a cross sectional view of the industrial oven taken on line 3—3 of FIG. 2 but on an enlarged scale.
Figure 4:
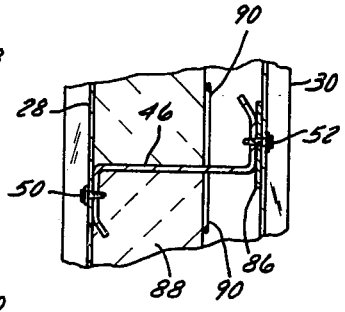
FIG. 4 is an enlarged, fragmentary cross-sectional view of a portion of the wall of the industrial oven shown in FIG. 3.
Figure 5:
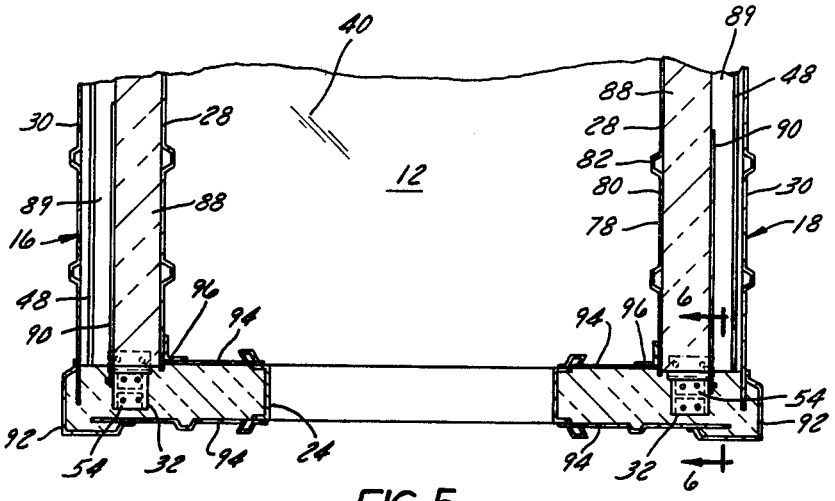
FIG. 5 is an enlarged cross sectional view of a portion of the doorways of the oven taken on line 5—5 of FIG. 1.

Expansion and contraction of the horizontally adjacent panels in a horizontal direction is accommodated in a different manner. The panels expand easily and in an accordion-like fashion along their corrugations, without damaging the inner skin and eliminating the need for expansion joints between adjacent panels. This accordion-like expansion may best be understood by referring to FIG. 5. A portion of a panel 78 of inner skin 28 is shown, and the panel includes a pair of flat portions 80 on either side of a substantially C-shaped corrugation 82. As the interior heating chamber 12 is heated, the panel 78 is also heated and begins to expand, the two adjacent flat panel portions 80 pulling away from each other and thereby pulling the opposite ends of the C-corrugation away from each other. In other words, the width of the corrugations can increase or decrease. Upon cooling, the panel contracts and the corrugation assumes its original, unheated configuration as shown in FIG. 5. As shown in FIGS. 1 and 3, the outer skin comprises corrugated panels attached to the zees with screws 52. A strip 86 of insulating material, such as silicon rubber or asbestos, (FIG. 4) is held is place by screw 52 and between the outer skin and the zee to reduce heat transfer to the outer skin and the screw 52.

Insulation Material Between Inner and Outer Skin

Insulation material 88 is located in the space between the inner and outer skins. The insulation is preferably of the rigid type and firmly bears against the inner skin and is spaced from the outer skin to provide an air space 89 within the wall. The inner skin and zees contact one another only where forced to do so by screws 50, the insulation between the zees and the interior of the inner skin acting to thermally insulate the inner skin from the framework for the majority of the inner skin's area.

Means are preferably provided between the skins for positively holding the insulation material against the inner skin and for maintaining a space between the insulation and the outer skin. This provides a dead air space within the wall which is important in preventing heat loss by conduction or convection. This holding means preferably comprises wires 90 which are stretched across the insulating material 88 and secured to the framework by conventional means. The insulation does not entirely fill the void between the inner and outer skin, and the air space between the insulation and the outer skin provides further thermal resistance. The air space is sealed, and communicative with neither the ambient air outside of the oven nor the interior heating chamber.

Insulation 87 is also placed within the insulated top 60 and adjacent the inner skin 61 of that top (FIG. 3) to create a dead air space 91 between the insulation 87 and the outer skin 63 of the top. The insulation is placed against the interior surface of the inner skin 63 of the top 60 and held in place by gravity.

Means are also provided for sealing the oven corners, as for example, where the doorways 24 and 26 are located along the walls or where the side walls meet the insulated top. Such means (FIG. 5) include corner trim 92, jamb trim 94, and inside trim 96, each being pop riveted into place upon the panels it abuts.

Resume

The invention provides an industrial oven with walls comprising panels of a corrugated sheet metal and having a frame comprising horizontal structural elements attached to vertical structural elements with a slideable connection, permitting slideable expansion of the horizontal elements along the connection without stressing the frame. Expansion of the panels occurs in an accordion-like fashion along the corrugations enabling placement of the panels in an overlapping fashion, eliminating panel channels or rails which conduct heat from the oven's interior and further eliminating joints through which heat could otherwise escape. Further expansion of the panels is accommodated by vertical slideable movement of an upper panel over a lower panel. The wall construction results in an outer skin that remains at a relatively cool temperature, reducing conduction heat losses through the wall and reducing convection losses from the outer skin to the ambient air. The structural framework is entirely enclosed within the inner and outer skins to further reduce heat losses, and the air space within the wall is a thermally efficient dead air space.

What we claim is:

1. An industrial oven for heating products therein and of the type having four insulated side walls, an insulated top and also a bottom which together define an interior heating chamber, and furthermore being of the type wherein said walls have an inner skin and an outer skin spaced apart from one another and with insulation material therebetween, and a structural steel framework means including generally horizontally disposed steel beams and vertical support posts secured together to form a rigid framework for supporting said skins, said inner and said outer skins each having an interior surface adjacent said framework, the improvement comprising said inner skin being of generally vertically corrugated sheet metal, said structural framework means being located between said inner and outer skins, said insulation material bearing against said inner skin and spaced from said outer skin to thereby provide a dead air space between said insulation material and said interior surface of said outer skin.

2. The oven set forth in claim 1 further characterized in that said inner skin is secured to said framework means by fastening means passing through said inner skin and secured to said framework means, said insulation material bearing against said inner skin to urge it away from said framework means for the majority of its area and except where said fastening means are located, to thereby prevent heat transfer by conduction from said inner skin to said framework means.

3. The oven set forth in claim 1 including a slideable connection between said vertical posts and said horizontal beams which permits expansion and contraction of said side wall.

4. The oven set forth in claim 3 wherein said slideable connection includes a slotted bracket and bolt means between said posts and said beams to permit relative movement therebetween.

5. The oven set forth in claim 4 further characterized in that said inner skin is fabricated from overlapping panels which can slide vertically relative to one another to accommodate vertical expansion and contraction of said inner skin.

6. The oven set forth in claim 1 including means for positively holding said insulation material against said inner skin for urging said material firmly against said inner skin.

7. An industrial oven for heating products therein and of the type having four insulated side walls, an insulated top and also a bottom which together define an interior heating chamber, and furthermore being of the type wherein said walls have an inner skin and an outer skin spaced apart from one another and with insulation material therebetween, and a structural steel framework for supporting said skins, said inner and said outer skins each having an interior surface adjacent said framework, the improvement comprising said inner skin being of generally vertically corrugated sheet metal, said structural steel framework being located between said inner and outer skins; said structural framework including generally horizontally disposed steel beams and also including vertical support posts, and a slot and bolt means connection between said vertical posts and said horizontal beams which permits expansion and contraction of said side wall; and means between said skins for holding said insulation material against said inner skin and spaced from said outer skin to thereby provide a dead air space between said insulating material and said interior surface of said outer skin, fastening means passing through said inner skin and secured to said framework for fastening said inner skin to said framework, said insulation material bearing against said inner skin to urge it away from said framework for the majority of its area and except where said fastening means are located, to thereby prevent heat transfer by conduction from said inner skin to said framework.

8. An industrial oven for heating products therein and of the type having four insulated side walls, an insulated top and also a bottom which together define an interior heating chamber, and furthermore being of the type wherein said walls have an inner skin and an outer skin spaced apart from one another and with insulation material therebetween, and a structural steel framework for supporting said skins, said inner and said outer skins each having an interior surface adjacent said framework, the improvement comprising said inner and said outer skins being of generally vertically corrugated sheet metal, said structural steel framework being located between said inner and outer skins, and means between said skins for holding said insulation material against said inner skin and spaced from said outer skin to thereby provide a dead air space between said insulation material and said interior surface of said outer skin, said inner skin comprising panels overlapping one another at their adjacent edges to thereby permit said inner skin to expand and contract in accordion fashion upon heating and cooling thereof.

9. The oven set forth in claim 8 further characterized in that said inner skin and said outer skin are secured to said framework by fastening means passing through said inner skin and said outer skin and secured to said framework, said insulation material bearing against said inner skin to urge it away from said framework for the majority of its area and except where said fastening means are located, to thereby prevent heat transfer by conduction from said inner skin to said framework.

10. The oven set forth in claim 8 further characterized in that said structural framework includes generally horizontally disposed steel beams and also includes vertical support posts, and a slideable connection between said vertical posts and said horizontal beams which permits expansion and contraction of said side wall.

11. The oven set forth in claim 10 wherein said slideable connection includes a slotted bracket and bolt means between said posts and said beams to permit relative movement therebetween.

12. The oven set forth in claim 11 further characterized in that said inner skin is fabricated from vertically overlapping panels which can slide vertically relative to one another to accommodate vertical expansion and contraction of said inner skin.

13. The oven set forth in claim 10 further characterized in that said holding means comprises wires stretched across said insulation material and secured to said framework for urging said material firmly against said inner skin.

14. An industrial oven for heating products therein and of the type having four insulated side walls, an insulated top and also a bottom which together define an interior heating chamber, and furthermore being of the type wherein said walls have an inner skin and an outer skin spaced apart from one another and with insulation material therebetween, and a structural steel framework for supporting said skins, said inner and said outer skins each having an interior surface adjacent said framework, the improvement comprising said inner skin and outer skin being of generally vertically corrugated sheet metal, said structural steel framework being located between said inner and outer skins; said structural framework including generally horizontally disposed steel beams and also including vertical support posts, and a slot and bolt means connection between said vertical posts and said horizontal beams which permits expansion and contraction of said side wall; and means between said skins for holding said insulation material against said inner skin and spaced from said outer skin to thereby provide a dead air space between said insulating material and said interior surface of said outer skin, fastening means passing through said inner skin and secured to said framework for fastening said inner skin to said framework, said insulation material bearing against said inner skin to urge it away from said framework for the majority of its area and except where said fastening means are located, to thereby prevent heat transfer by conduction from said inner skin to said framework, said panels overlapping one another at their adjacent edges to thereby permit said skins to expand and contract in accordion fashion upon heating and cooling thereof.

15. An industrial oven for heating products therein and of the type having four insulated side walls, an insulated top and also a bottom which together define an interior heating chamber, and furthermore being of the type wherein said walls have an inner skin and an outer skin spaced apart from one another and with insulation material therebetween; said inner skin being fabricated from vertically overlapping panels comprising an upper and a lower tier of panels, said upper and lower tiers being vertically slideable relative to one another to accommodate vertical expansion and contraction of said inner skin, said panels overlappingly engaged at their horizontally adjacent ends, and a structural steel framework for supporting said skins, the improvement comprising said inner skin and said outer skin being of sheet metal and having generally vertical corrugations therein, said structural steel framework being located substantially entirely between said inner and outer skins; said structural framework including generally horizontally disposed steel beams and also including vertical support posts, said horizontal steel beams having slots therein, and slotted bracket and bolt means between said vertical posts and said horizontal beams which permits expansion and contraction of said side wall, said inner skin being expandable in accordion fashion upon heating and cooling thereof; each of said skins having an interior surface adjacent said framework, for holding said insulation material against said inner skin and spaced from said outer skin to thereby provide an air space between said insulation material and said interior surface of said outer skin, said air space being sealed and non-communicative to thereby ensure that said air space is a thermally efficient dead air space, said inner skin and said outer skin being secured to said framework by fastening means passing therethrough and secured to said framework, said insulation material bearing against said inner skin to urge it away from said framework for the majority of its area and except where said fastening means are located, to thereby prevent heat transfer by conduction from said inner skin to said framework.

16. The oven set forth in claim 9 further comprising an insulating strip between said outer skin and said structural framework and held in place by said outer skin fastening means.

* * * * *